US008683929B2

(12) United States Patent
Peery et al.

(10) Patent No.: US 8,683,929 B2
(45) **Date of Patent: *Apr. 1, 2014**

(54) TABLE WITH NESTING TABLE TOP

(75) Inventors: Wendell Peery, Kaysville, UT (US); David C. Winter, Layton, UT (US); Mitch Johnson, South Weber, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/592,230

(22) Filed: Aug. 22, 2012

(65) Prior Publication Data

US 2013/0055929 A1 Mar. 7, 2013

Related U.S. Application Data

(60) Provisional application No. 61/531,081, filed on Sep. 5, 2011, provisional application No. 61/543,277, filed on Oct. 4, 2011.

(51) Int. Cl.
*A47B 3/00* (2006.01)

(52) U.S. Cl.
USPC ..... 108/132; 108/129

(58) Field of Classification Search
USPC ..... 108/91, 92, 93, 53.1, 53.3, 53.5, 129, 108/132
See application file for complete search history.

(56) References Cited

U.S. PATENT DOCUMENTS 1,593,975 A * 7/1926 Karstens ..... 108/91
1,856,935 A * 5/1932 Turner ..... 108/91
2,540,849 A 2/1951 Walker
2,889,185 A * 6/1959 Heisler ..... 108/91
3,389,511 A 6/1968 Drehobl
3,917,108 A 11/1975 Thurman
4,570,993 A 2/1986 Widerker
4,841,877 A 6/1989 Virtue
5,381,740 A 1/1995 Johnston
5,421,272 A 6/1995 Wilmore
5,505,142 A * 4/1996 Fink ..... 108/91
5,664,934 A 9/1997 Schaede et al.
5,775,655 A 7/1998 Schmeets
5,960,720 A * 10/1999 Borland et al. ..... 108/53.1
5,983,807 A 11/1999 Tarnay et al.
6,058,853 A 5/2000 Pinch (Continued)

OTHER PUBLICATIONS

European Search Report from EPO Application No. EP12183082 dated Nov. 20, 2012.

(Continued)

*Primary Examiner* — Jose V Chen
(74) *Attorney, Agent, or Firm* — Maschoff Brennan

(57) ABSTRACT

A table may be sized and configured to nest with another table to reduce a height of a plurality of stacked tables in a nested configuration. The table may include a table top with a receiving portion disposed at least proximate an intersection of an upper surface and a sidewall. The table top may also include a lip and a lower portion of the lip may include a contact surface that is sized and configured to contact an upper surface of an adjacent, nested table. The lower portion of the lip may also include an engaging portion that is sized and configured to be disposed in a receiving portion of an adjacent, nested table. The contact surface and the engaging portion may be directly adjacent to each other in the lower portion of the lip.

18 Claims, 10 Drawing Sheets

(56) References Cited

U.S. PATENT DOCUMENTS

| | | | | |
|---|---|---|---|---|
| 6,112,674 | A | 9/2000 | Stanford | |
| 6,199,487 | B1 | 3/2001 | Coddington | |
| 6,394,004 | B1 * | 5/2002 | Lynn | 108/91 |
| 6,722,293 | B2 | 4/2004 | Lee | |
| 6,732,663 | B2 * | 5/2004 | Tsai | 108/91 |
| 6,752,091 | B2 | 6/2004 | Glover et al. | |
| 6,772,700 | B2 | 8/2004 | Wong | |
| 7,069,865 | B2 | 7/2006 | Strong et al. | |
| 7,073,450 | B2 | 7/2006 | Tsai | |
| 7,096,800 | B2 | 8/2006 | Stanford | |
| 7,100,518 | B2 | 9/2006 | Strong | |
| 7,111,563 | B2 * | 9/2006 | Strong | 108/132 |
| 7,150,237 | B2 * | 12/2006 | Lin et al. | 108/132 |
| 7,171,910 | B2 | 2/2007 | Neunzert et al. | |
| 7,278,361 | B2 | 10/2007 | Zhurong et al. | |
| 7,428,872 | B2 | 9/2008 | Strong et al. | |
| 7,634,969 | B2 | 12/2009 | Neunzert et al. | |
| 7,640,870 | B2 | 1/2010 | Strong et al. | |
| 7,707,947 | B2 | 5/2010 | Winter et al. | |
| 7,752,982 | B2 | 7/2010 | Lin | |
| 7,799,482 | B2 * | 9/2010 | Cho et al. | 108/91 |
| 7,905,185 | B2 | 3/2011 | Peery et al. | |
| 8,006,630 | B2 | 8/2011 | Strong et al. | |
| 8,033,228 | B2 | 10/2011 | Haney | |
| 8,042,476 | B2 | 10/2011 | Stanford | |
| 8,074,582 | B2 * | 12/2011 | Stanford | 108/132 |
| 8,091,289 | B2 | 1/2012 | Mower et al. | |
| 8,161,711 | B2 | 4/2012 | Steed et al. | |
| D662,738 | S | 7/2012 | Winter et al. | |
| 8,267,018 | B2 | 9/2012 | Gunn | |
| 2003/0167981 | A1 | 9/2003 | Cai et al. | |
| 2003/0221595 | A1 * | 12/2003 | Reinsch et al. | 108/91 |
| 2003/0233968 | A1 | 12/2003 | Strong et al. | |
| 2005/0045074 | A1 | 3/2005 | Jin | |
| 2005/0098068 | A1 | 5/2005 | Tsai | |
| 2005/0155531 | A1 | 7/2005 | Chang | |
| 2005/0268827 | A1 | 12/2005 | Stanford | |
| 2006/0019776 | A1 | 1/2006 | Mower | |
| 2006/0230989 | A1 | 10/2006 | Haney et al. | |
| 2007/0101910 | A1 | 5/2007 | Haimoff et al. | |
| 2007/0199483 | A1 | 8/2007 | Peery et al. | |
| 2007/0272128 | A1 | 11/2007 | Lin | |
| 2008/0060563 | A1 | 3/2008 | Yang | |
| 2009/0114131 | A1 * | 5/2009 | Haney et al. | 108/132 |
| 2012/0266790 | A1 | 10/2012 | Peery et al. | |

OTHER PUBLICATIONS

U.S. Appl. No. 13/604,557, filed Sep. 5, 2012, Peery, et al.
U.S. Appl. No. 13/455,041, filed Apr. 24, 2012, Peery, et al.
U.S. Appl. No. 13/455,055, filed Apr. 24, 2012, Peery, et al.
U.S. Appl. No. 13/455,066, filed Apr. 24, 2012, Peery, et al.
U.S. Appl. No. 13/455,073, filed Apr. 24, 2012, Peery, et al.
U.S. Appl. No. 13/455,076, filed Apr. 24, 2012, Peery, et al.
U.S. Appl. No. 13/455,081, filed Apr. 24, 2012, Peery et al.
U.S. Appl. No. 13/559,062, filed Jul. 26, 2012, Jin, et al.
Office Action from U.S. Appl. No. 13/455,041 dated Jun. 27, 2012.
Office Action from U.S. Appl. No. 13/455,055 dated Jun. 27, 2012.
Office Action from U.S. Appl. No. 13/455,076 dated Sep. 4, 2012.
Office Action from U.S. Appl. No. 13/455,081 dated Sep. 11, 2012.
Office Action from U.S. Appl. No. 13/559,062 dated Dec. 19, 2012.
Office Action from U.S. Appl. No. 13/604,557 dated Dec. 20, 2012.
Notice of Allowance from U.S. Appl. No. 13/455,041 dated Oct. 23, 2012.
Notice of Allowance from U.S. Appl. No. 13/455,055 dated Oct. 17, 2012.
Notice of Allowance from U.S. Appl. No. 13/455,066 dated Sep. 10, 2012.
International Search Report and Written Opinion from PCT/US2012/035058 dated Jul. 13, 2012.
International Search Report and Written Opinion from PCT/US2012/035054 dated Jul. 17, 2012.
International Search Report and Written Opinion from PCT/US2012/035055 dated Jul. 17, 2012.
International Search Report and Written Opinion from PCT/US2012/035056 dated Jul. 17, 2012.
International Search Report and Written Opinion from PCT/US2012/035059 dated Jul. 17, 2012.
International Search Report and Written Opinion from PCT/US2012/035061 dated Jul. 17, 2012.
International Search Report and Written Opinion from PCT/US2012/048485 dated Oct. 15, 2012.
Notice of Allowance from U.S. Appl. No. 13/604,557 dated Jul. 30, 2013.

* cited by examiner

TABLE WITH NESTING TABLE TOP

CROSS-REFERENCE TO RELATED APPLICATIONS

The present application claims priority to and the benefit of U.S. provisional patent application Ser. No. 61/531,081, entitled TABLE, which was filed on Sep. 5, 2011; and U.S. provisional patent application Ser. No. 61/543,277, entitled TABLE, which was filed on Oct. 4, 2011; each of which is hereby incorporated by reference in its entirety.

BACKGROUND

1. Field of the Invention

The present invention generally relates to tables and, in particular, to tables that may nest together.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. These types of tables can often be positioned in an assortment of different configurations and used in a variety of settings. When banquet tables are no longer needed, the table legs can be moved into the storage position and the tables may be more easily moved or stored.

Because most banquet tables have a length between six and ten feet and a width between three and four feet, the required storage area for such tables is quite large even with the legs in the collapsed position. This large storage area may be problematic for businesses or facilities such as hotels, schools and churches because a considerable number of these tables may have to be stored. The large size of conventional banquet tables may also be problematic for manufacturers, retailers and consumers because a number of tables may have to be stored, transported and/or displayed.

BRIEF SUMMARY

A need therefore exists for a table that eliminates or diminishes the above-described disadvantages and problems.

One aspect is a table that may include a table top and one or more legs sized and configured to support the table top above a surface such as the floor or ground. The table may also include a frame and the legs may be connected to the frame. The legs may be movable relative to the table top between a collapsed or storage position and an extended or use position. In particular, the legs may be pivoted between a collapsed position in which the legs are disposed at least proximate a lower surface of the table top and an extended position in which the legs extend outwardly from the table top. If desired, the legs may at least partially contact or abut the lower surface of the table top when the legs are in the collapsed position. In addition, the lower surface of the table top may include one or more recesses sized and configured to receive at least a portion of the legs when the legs are in the collapsed position. Advantageously, this may decrease the amount of space required to store and/or transport the table.

Another aspect is a table that may be relatively lightweight, which may allow the table to be more easily transported and moved. For example, the table may include a lightweight table top and that may reduce the overall weight of the table. The table may also be constructed from a limited number of parts or components, which may allow the weight of the table to be reduced.

Still another aspect is a table that may include a table top constructed from plastic. For example, the table top may be constructed from molded plastic using blow-molding, injection molding, rotary molding or other suitable molding processes. The molded plastic table top may provide a relatively rigid, high-strength structure that is capable of withstanding repeated use and wear. The molded plastic table top may also be relatively quickly, easily and efficiently manufactured. In addition, the molded plastic table top may be readily molded into the desired size and shape, such as for a utility table, card table, personal table and the like. The molded plastic table top may be relatively lightweight because, for instance, it may include a hollow interior portion that is formed during the molding process. The molded plastic table top may further include two opposing walls, which may be spaced apart by a generally constant and/or predetermined distance, and that may help increase the strength and rigidity of the table top. The table top may also include one or more depressions, tack-offs or other structures which may be sized and configured to help support an opposing surface. Additionally, the molded plastic table top may be generally weather resistant and temperature insensitive. Further, the molded plastic table top may not corrode, rust or otherwise deteriorate over an extended period of time, which may help create a long-lasting table.

Yet another aspect is a table that may be sized and configured to facilitate stacking a plurality of tables. In addition, the tables may be sized and configured to be easily aligned. Advantageously, the table top may be sized and configured to facilitate both stacking and alignment of the tables. Significantly, the tables may be aligned vertically, horizontally or at an angle depending, for instance, if the tables are to be shipped, stored, displayed, or the like. If desired, the stacked tables may lock or have a tendency to stay together. For instance, a friction or interference fit between adjacent stacked tables may tend to maintain the tables in a stacked configuration. If the tables have a penchant to stay together, this may help reduce damage to the tables during shipping, storage and/or display.

Still yet another aspect is a table that may be sized and configured to nest with an adjacent table. Advantageously, nested tables may allow a plurality of tables to be stored in a smaller area, which may substantially reduce storage and shipping costs. The nested tables may also allow a greater number of tables to be stored in the same area as conventional tables that do not nest together. In addition, the nested tables may help protect the tables from damage. Significantly, the nested tables may have the same general footprint as a conventional table, but the nested tables may allow significantly more tables to be disposed on a pallet, in a shipping container or in a given storage space.

A further aspect is a table top that may facilitate stacking and nesting. For example, the table top may be constructed from molded plastic, such as blow-molded plastic, and it may include a downwardly extending lip disposed about an outer edge or perimeter of the table top. The lip may be disposed about the entire periphery of the table top and it may be unbroken or uninterrupted. The lip may be aligned with or proximate an outer surface or sidewall of the table top and the thickness of the lip may vary. For instance, the thickness of the lip along the sides and/or ends of the table top may be generally constant and/or the same, but the thickness of the lip in the corners may be significantly smaller because an inner surface of the lip may be curved or disposed towards the outer surface of the lip.

A still further aspect is a table top that may include a portion of a lip sized and configured to contact or abut an upper surface of an adjacent, nested table. For example, the lip may include a contact surface that is sized and configured to contact or abut the upper surface of the adjacent, nested table. The contact surface may be generally planar, smooth and free from projections to match the corresponding upper surface of the table top of the adjacent, nested table. The contact surface may have generally the same size along one or more of the sides and/or ends of the table top. The contact surface may have a different size in the corners of the table top. For example, the contact surfaces in the corners may have a width generally equal to or more than fifty percent (50%), seventy-five (75%) or ninety (90%) smaller than the width of the contact surfaces along the sides and/or ends of the table top. All or a portion of the corners may also not include a contact surface depending, for example, upon the configuration of the table top.

Yet another further aspect is a table top that may include an engaging or nesting portion sized and configured to be disposed in a receiving portion of an adjacent, nested table. The engaging portion may be an outwardly extending protrusion that projects from a lower portion of the lip and the engaging portion may be sized and configured to fit within the receiving portion, such as a groove or cutout, of the adjacent, nested table. Advantageously, the engaging portion may directly support at least a portion of the weight and/or forces applied to the tables in the nested configuration, which may help prevent damage to the tables. For example, when the tables are stacked in a horizontal configuration, the engaging portion of one table top may contact the receiving portion of the adjacent, stacked table in a manner that allows the stacked tables to support a significant amount of weight without damage to the tables. This may allow ten, twenty, thirty or more tables to be disposed in a stacked configuration without damaging any of the tables. In addition, the engaging and receiving portions may facilitate stacking, storing and/or shipping of the tables because these components may help maintain the tables in the stacked configuration and ensure the weight is properly and/or evenly distributed.

Another aspect is a table top that may include an engaging portion constructed from molded plastic, such as compression molded plastic, which may be formed during a blow-molding process. Advantageously, the molded plastic engaging portion may help create a stronger, more rigid and/or increased impact resistant structure, which may enhance the durability and usefulness of the table. In addition, if the engaging portion is constructed from compression molded plastic, that may allow the engaging portion to be relatively thin because there is little or no gap or space between the walls of the compression molded plastic structure.

Still another aspect is a table top that may include an engaging portion, such as a protrusion, which facilitates nesting and stacking of the tables. The protrusion may include a hollow interior portion that is in direct communication with a hollow interior portion of the lip and/or the table top. Advantageously, the table top, lip and protrusion may be integrally formed as part of a unitary, one-piece construction if the table top is constructed from blow-molded plastic. In addition, the hollow interior portions of the table top, lip and protrusion may be simultaneously formed during the blow-molding process. The protrusion, however, does not require a hollow interior portion and it could, for example, be an at least substantially solid structure. For example, the protrusion could extend downwardly from a lower portion of the lip and the upper portion of the protrusion could be generally aligned with the lower portion of the lip.

Yet another aspect is a table top that may include a receiving or nesting portion, such as a groove, channel or recessed portion, sized and configured to receive a portion of an adjacent table top to facilitate nesting of the tables. For example, the receiving portion may be disposed about an upper surface and/or outer perimeter of the table top. In greater detail, the receiving portion may be disposed in the upper, outer perimeter of the table top and it may have a generally L-shaped configuration with a lower surface generally parallel to the upper surface of the table top and a side wall generally perpendicular to the upper surface of the table top. An engaging portion of an adjacent, stacked table top may be disposed in the receiving portion to allow the tables to be nested together.

Still yet another aspect is a table top that may have dimensions similar to a conventional table top, but the table top can be nested with an adjacent table top to reduce the height of the stacked tables. Advantageously, because the nesting table top may have the same general size and configuration as a conventional table top, the nesting table top may have the same general strength, structural integrity, rigidity and/or torsion resistance as a conventional table top. The similar size and configuration of the table tops may allow consumers to immediately infer the nesting table tops have the same general strength, structural integrity, rigidity and/or torsion resistance as conventional table tops. The nesting table tops, however, may significantly decrease the height of two or more stacked tables. The substantial decrease in height of the nested tables may result in considerable space savings that may be very important to the manufacturer during the manufacturing and shipping process; to the retailer when storing or displaying the tables; and/or to a consumer purchasing, transporting or storing more than one table.

A further aspect is a table top that may be nested with an adjacent table top to reduce the height of two or more stacked tables, which may result in a significantly reduced height in comparison to conventional tables that do not nest together. For example, known tables may have a table top with a height of about two and one-eighth (2.125) inches and thirty (30) of these conventional tables would have a stacked height of at least 63.75 inches. An exemplary embodiment of a nesting table top may have an overall height of about one and five-eighths (1.625) inches and it may overlap with an adjacent table by about one-eighth (0.125) inch so the height of the table top in the nested configuration may only be about one and one-half (1.5) inches. Consequently, the nested tables may have a reduction in height of about one-eighth (0.125) inch per stacked table in comparison to conventional tables. Thus, the height of thirty nested tables may be only about 45.125 inches while the height of thirty stacked conventional tables is much larger. Therefore, the nesting table tops may greatly increase the number of tables that can be stacked on a pallet or shelf, or disposed in a shipping container or truck.

A still further aspect is a table top that may be nested with another table top to decrease the height of the nested table top by about seven percent (7%) or more. For example, the height of a single table top may be about one and five-eighths (1.625) inches. When the table top is nested with another table top, the height of the table top may be about one and one-half (1.5) inches because a portion of the table tops may overlap. In this embodiment, the nested table top results in a decrease in height of each stacked table by about one-eighth (0.125) inch. Therefore, the height of a table top in the stacked configuration may be about seven percent (7%) less than in the non-stacked configuration. This may result in significant savings and cost advantages because, for example, considerably more tables may be stored, transported or displayed in the same area; or the same number of tables may be stored, transported or displayed in an area that is at least seven percent smaller. When large volumes of tables are being transported, such as in a standard or high-capacity shipping container, this may result in sizeable cost savings and advantages.

Yet another further aspect is a table top that may be nested with another table top to reduce the height of the nested table top by approximately twenty percent (20%) or more. For example, the height of a conventional blow-molded plastic table top is typically two (2.0) or more inches. The nesting table top may have a height of about two (2.0) inches when it is not nested with another table top, but the nesting table top may have a height between about one and one-half (1.5) and one and three-quarters (1.75) inches when nested with another table top. This may result in a significant reduction in height between twelve and one-half percent (12.5%) and twenty-five percent (25%) when two table tops are nested together. In particular, if the nested table tops are decreased in height by about twenty percent (20%), then the tables may have a height of about 1.6 inches in the nested configuration.

Another aspect is a frame that may be sized and configured to facilitate stacking of the tables. For example, the frame may include side rails and a lower portion or surface of the side rails may be sized and configured to contact an upper surface of an adjacent, stacked table. In particular, the lower portions of the side rails may have generally flat, planar surfaces that are generally aligned with and contact the upper surface of an adjacent table top when the tables are disposed in a stacked configuration. Advantageously, the frame may provide additional contact areas between adjacent, nested tables.

Still another aspect is a table that may be sized and configured to nest with an adjacent, stacked table in which a weight or force is supported by multiple areas, in different locations and/or by different surfaces. Advantageously, the multiple contact areas may allow stresses and forces to be disposed over a larger area and that may help prevent damage to the tables. For example, a lower portion of the lip may include a contact surface sized and configured to contact the upper surface of the adjacent table top. In addition, an engaging portion may be sized and configured to contact a receiving portion of the adjacent, stacked table. Further, the frame may include a lower surface sized and configured to contact the upper surface of the adjacent table top. When two or more tables are nested together, the multiple contact areas may facilitate stacking of the tables without marring or otherwise damaging the tables.

These and other aspects, features and advantages of the present invention will become more fully apparent from the following brief description of the drawings, the drawings, the detailed description of preferred embodiments and appended claims.

BRIEF DESCRIPTION OF THE DRAWINGS

The appended drawings contain figures of exemplary embodiments to further illustrate and clarify the above and other aspects, advantages and features of the present invention. It will be appreciated that these drawings depict only exemplary embodiments of the invention and are not intended to limits its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF PREFERRED EMBODIMENTS

The present invention is generally directed towards a table with a nesting table top. The principles of the present invention, however, are not limited to tables with nesting table tops. It will be understood that, in light of the present disclosure, the tables disclosed herein can have a variety of shapes, sizes, configurations and arrangements. It will also be understood the tables may include any suitable number and combination of features, components, aspects and the like. In addition, while the tables shown in the accompanying figures are illustrated as being banquet or utility tables, it will be appreciated the tables could be other suitable types of tables such as round, personal, conference or card tables. Further, the invention disclosed herein may be successfully used in connection with other types of furniture and/or structures.

Additionally, to assist in the description of exemplary embodiments of the table, words such as top, bottom, front, rear, right and left may be used to describe the accompanying figures which may be, but are not necessarily, drawn to scale. It will further be appreciated the tables can be disposed in a variety of desired positions or orientations, and used in numerous locations, environments and arrangements. A detailed description of exemplary embodiments of the table now follows.

Figure 1:
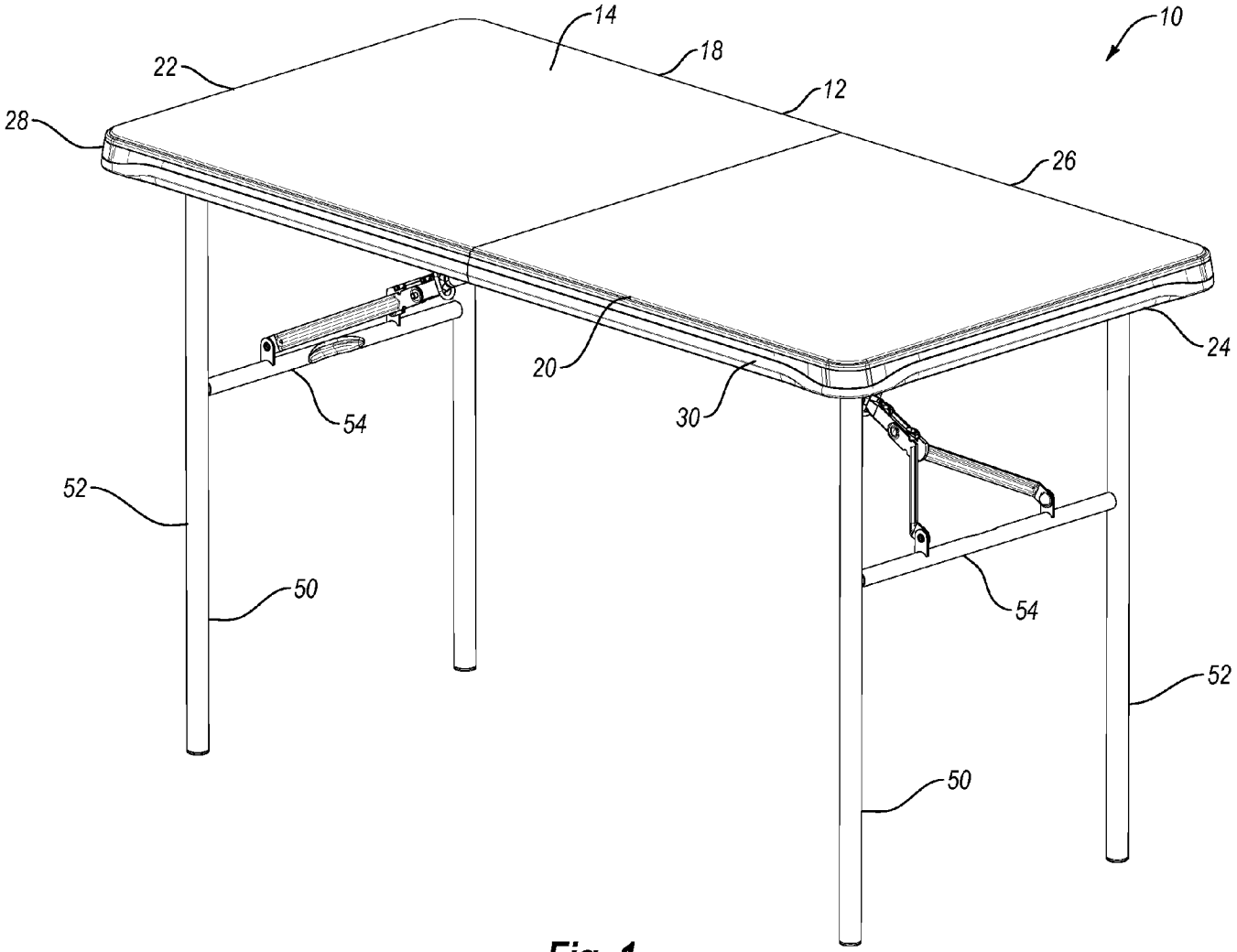
FIG. 1 is an upper perspective view of an exemplary table.

As shown in FIG. 1, an exemplary table 10 may include a table top 12 and the table top may be constructed from molded plastic. The table top 12 may include an upper portion or surface 14, a lower portion or surface 16, a first side 18, a second side 20, a first end 22 and a second end 24. The table top 12 may also include a perimeter 26, which may include an outer edge or sidewall. As shown in the accompanying figures, the table top 12 may have a rectangular configuration with four corners 28, but it will be understood that the table top may have any number of corners and it may have other shapes and configurations such as square, triangular, polygon, round and the like. In addition, it will be understood that the upper portion 14 may be spaced apart from the lower portion 16 of the table top 12 by a distance, which may be a generally constant distance, and a hollow interior portion may be disposed between the upper and lower portions of the table top.

Figure 2:
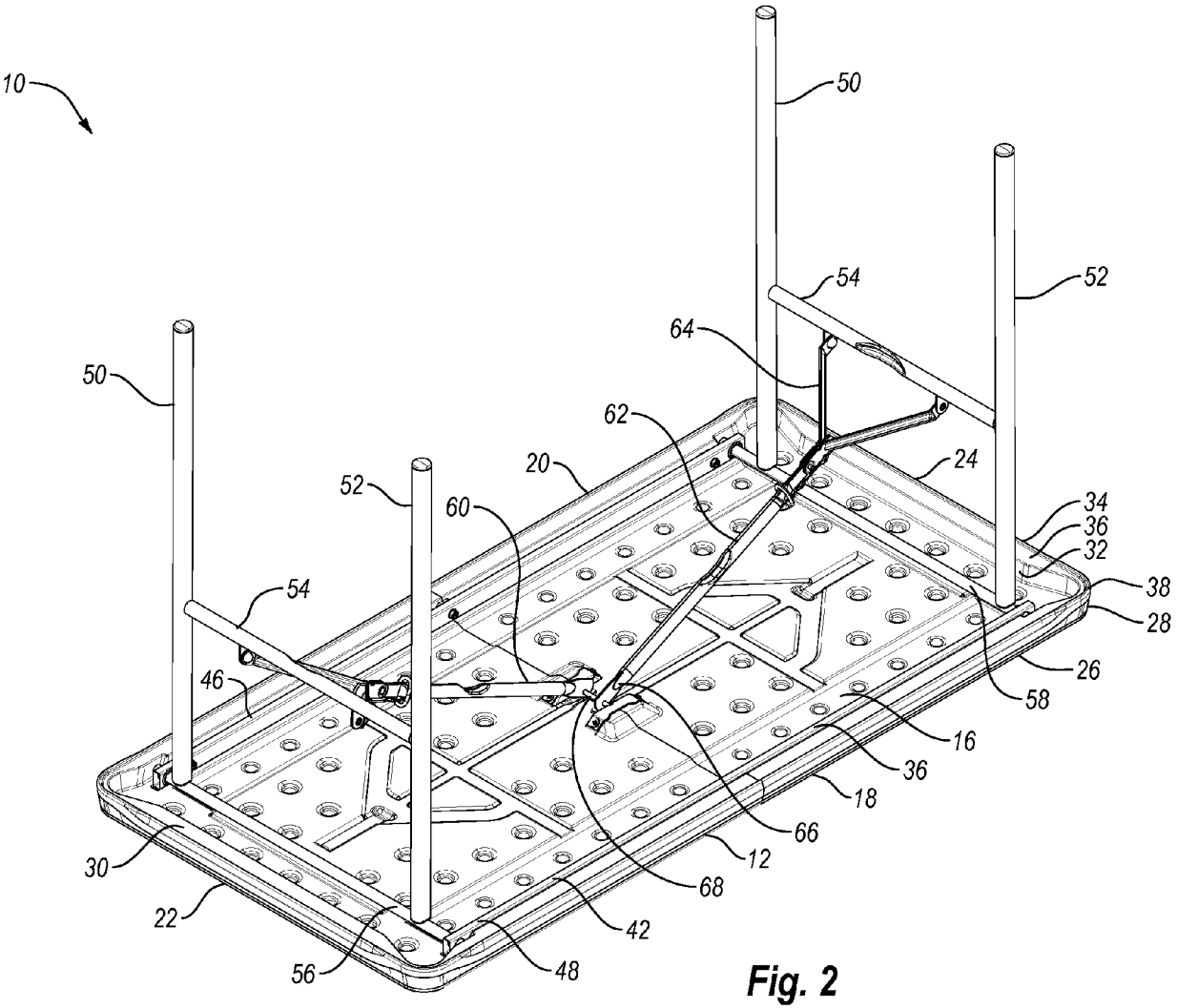
FIG. 2 is a lower perspective view of the table shown in FIG. 1, illustrating the support structures or legs in an extended or use position.
Figure 3:
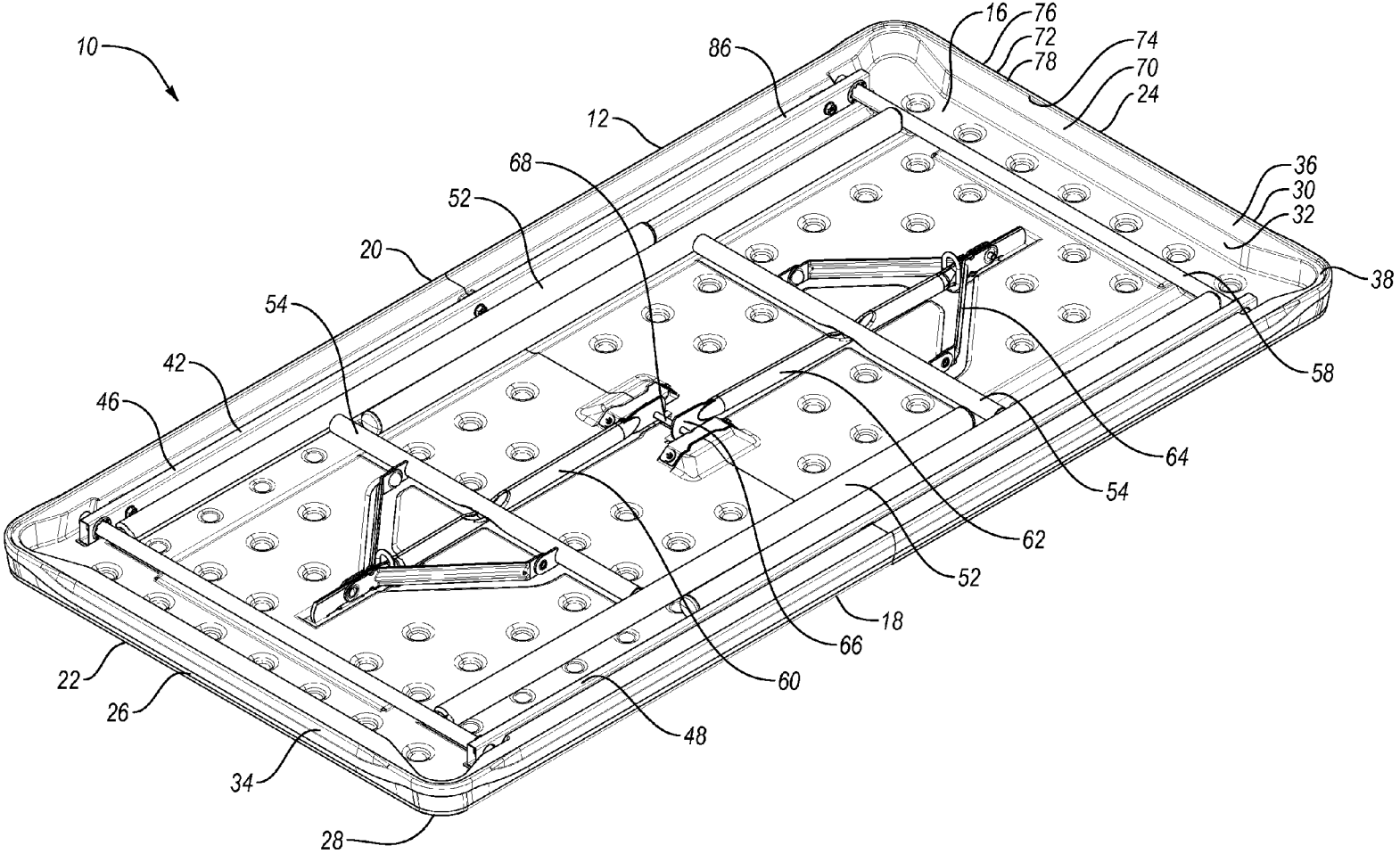
FIG. 3 is another lower perspective view of the table shown in FIG. 1, illustrating the support structures or legs in a collapsed position.
Figure 4:
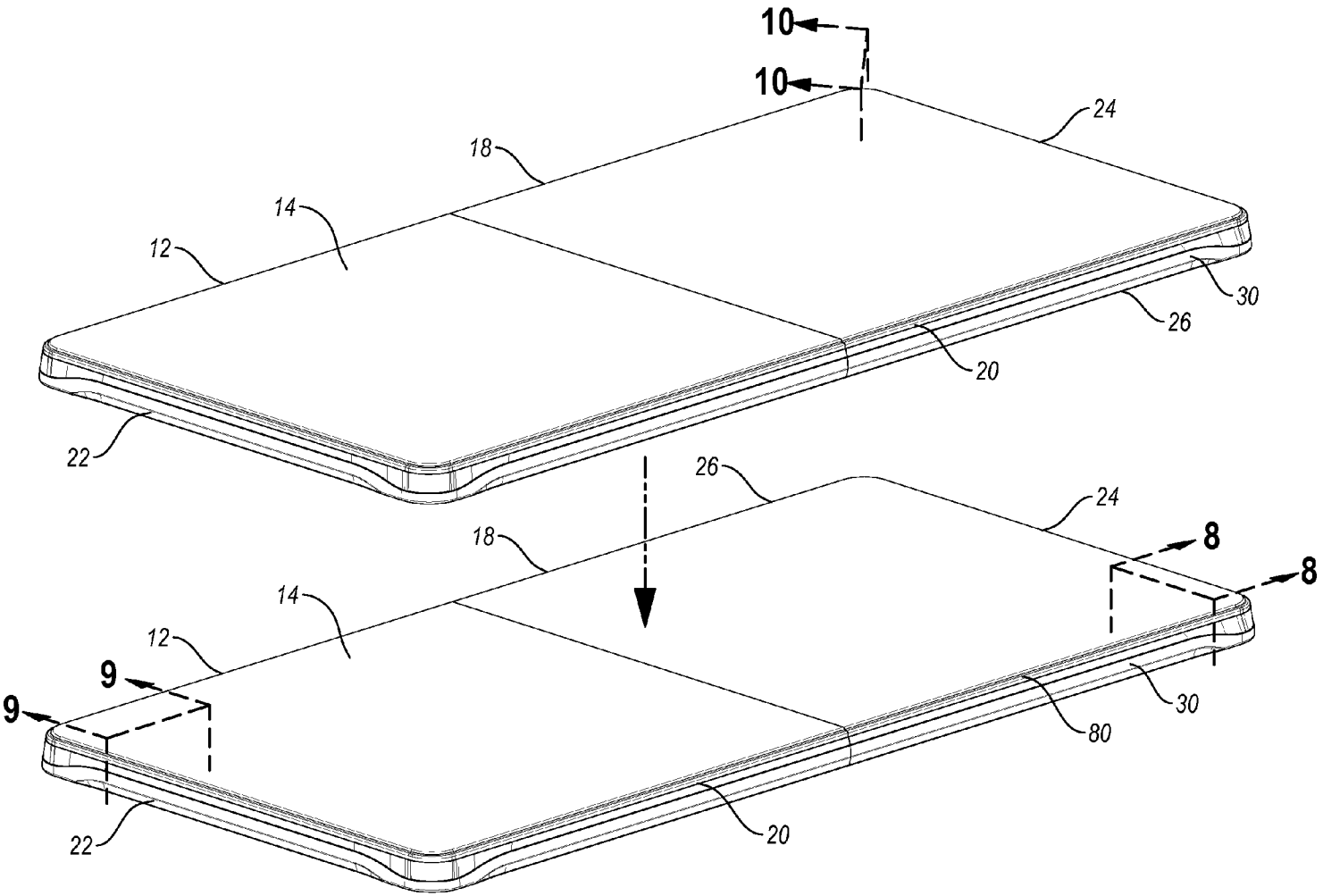
FIG. 4 is a perspective view of two exemplary tables in a vertically aligned configuration.
Figure 5:
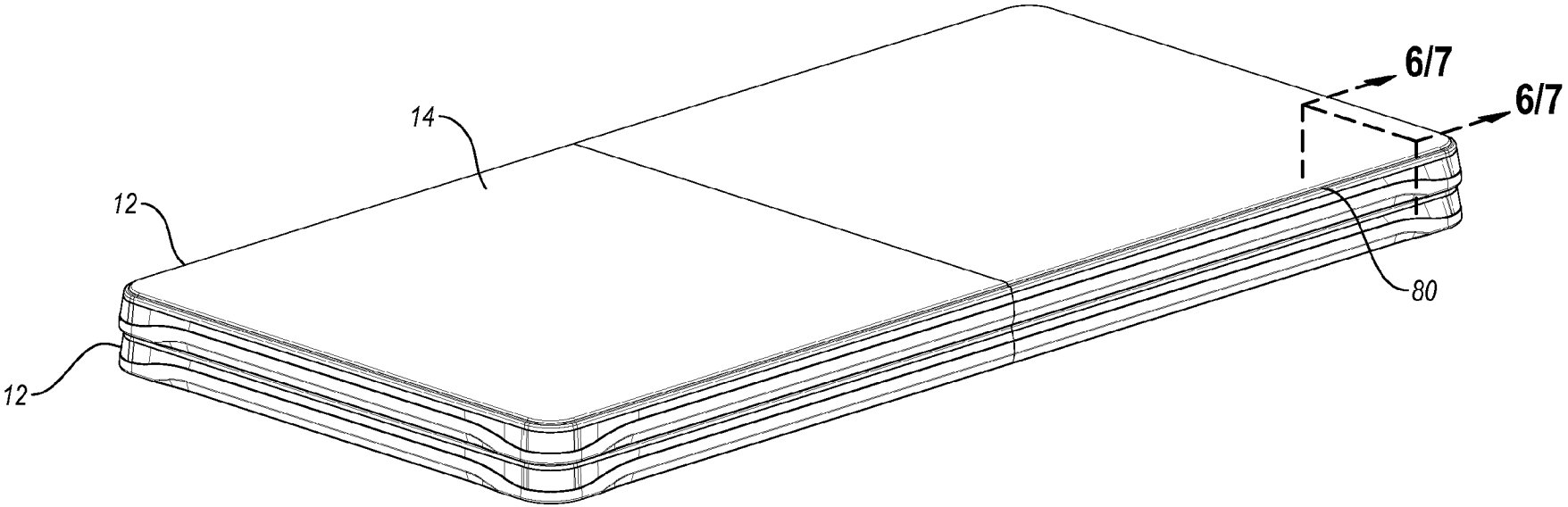
FIG. 5 is a perspective view of the tables shown in FIG. 4, illustrating the tables in a nested configuration.
Figure 6:
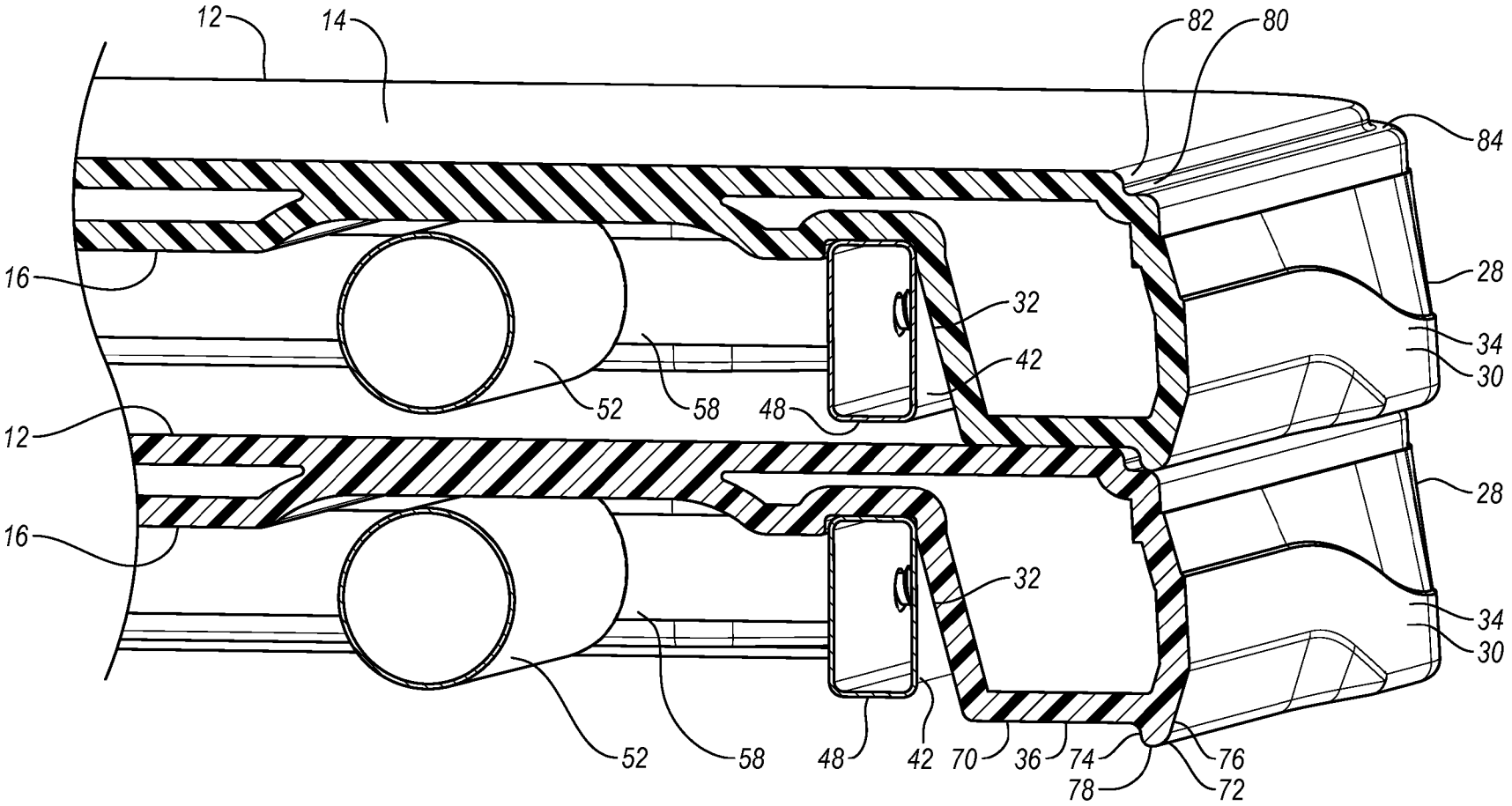
FIG. 6 is an enlarged cross-sectional perspective view along lines 6-6 of a portion of the tables shown in FIG. 5.
Figure 7:
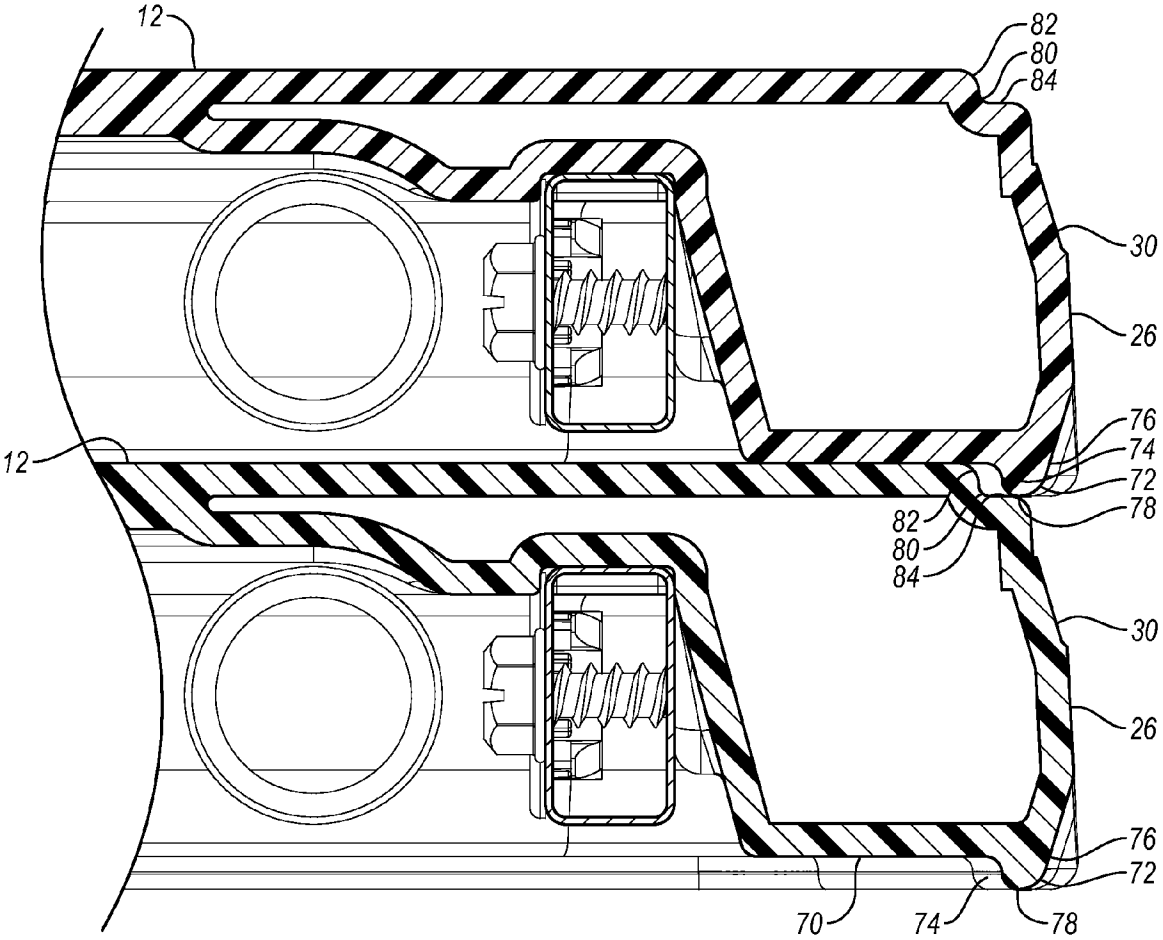
FIG. 7 is an enlarged cross-sectional side view along lines 7-7 of a portion of the tables shown in FIG. 5.
Figure 8:
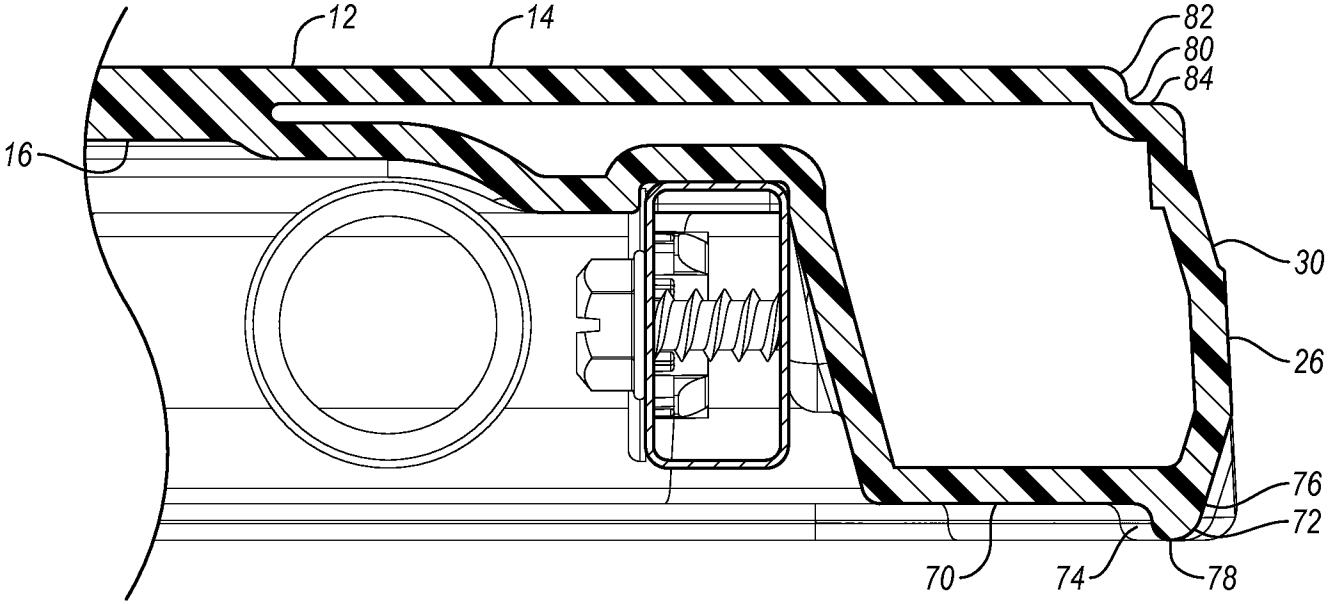
FIG. 8 is an enlarged cross-sectional side view along lines 8-8 of a portion of a table shown in FIG. 4.
Figure 9:
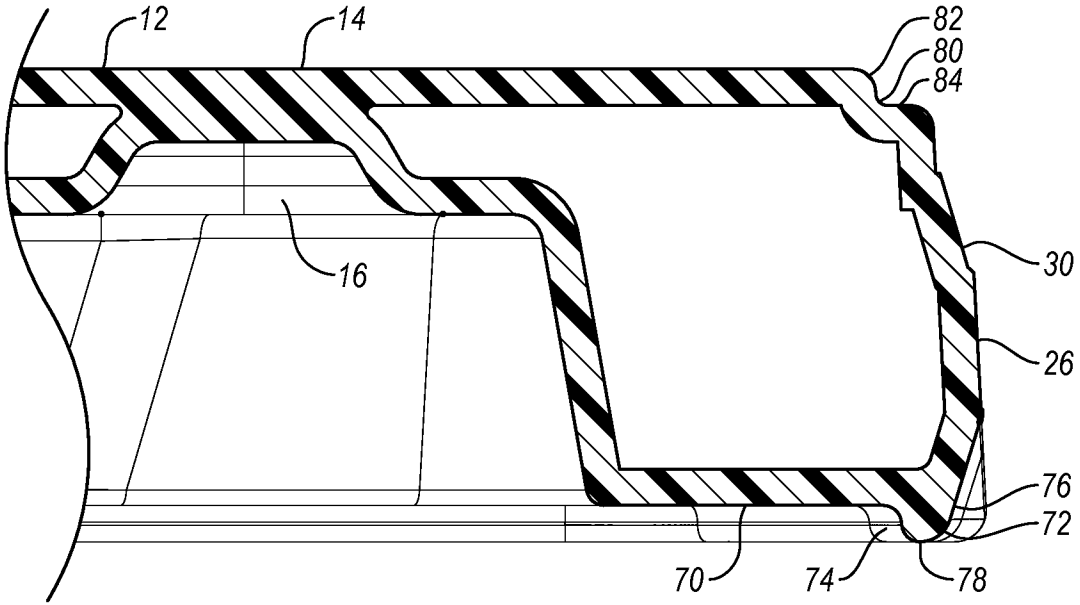
FIG. 9 is an enlarged cross-sectional side view along lines 9-9 of a portion of a table shown in FIG. 4.
Figure 10:
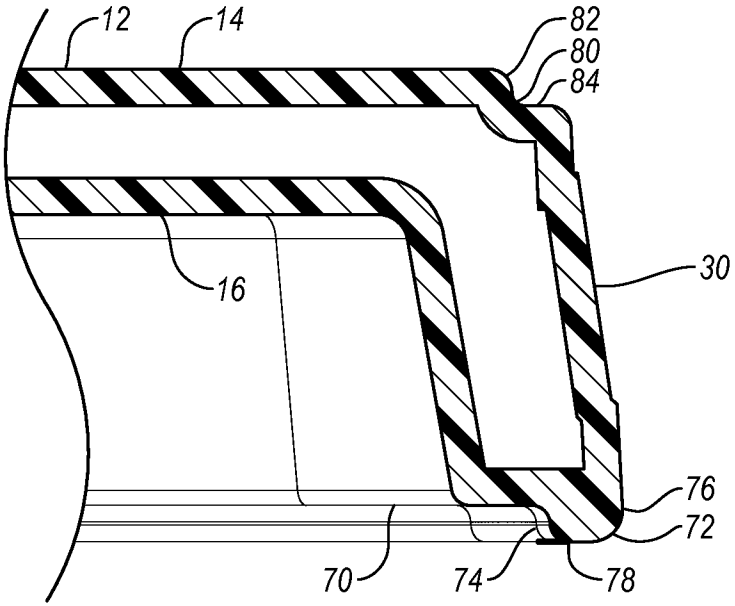
FIG. 10 is an enlarged cross-sectional side view along lines 10-10 of a portion of the table shown in FIG. 4.

In greater detail, the table top 12 may be constructed from blow-molded plastic and the hollow interior portion may be formed during the blow-molding process. The table top 12 may also be integrally formed during the blow-molding process as part of a unitary, one-piece construction or structure. It will be appreciated that the table top 12 may also be constructed using other suitable processes such as injection molding, rotary molding, extrusion molding, thermoforming, vacuum forming and the like. It will further be appreciated that the table top 12 may be constructed using other materials such as wood, metal, composites and the like As shown in FIGS. 2 and 3, the table top 12 may also include an outwardly extending lip 30. In particular, the lip 30 may extend downwardly from the lower portion 16 of the table top and the lip may include an inner portion 32, an outer portion 34 and a lower portion 36. As shown in the accompanying figures, the lip 30 may have a generally U-shaped configuration and the inner portion 32, the outer portion 34 and the lower portion 36 may have generally flat or planar surfaces. The lip 30 may also be disposed about the perimeter 26 or outer edge of the table top 12. In particular, the lip 30 may be disposed about the boundary or periphery of the table top 12 with the outer portion 34 of the lip generally aligned with the sidewall of the table top 12. It will be understood that all or a portion of the lip 30 may also be spaced inwardly from the perimeter 26 of the table top 12. Additionally, it will be understood that the lip 30 could have other appropriate configurations such curved, rounded, V-shaped and the like.

The lip 30 may extend completely around the perimeter 26 of the table top 12. In particular, the lip 30 may be disposed about the entire perimeter 26 of the table top 12 and the lip may be unbroken or uninterrupted. Thus, for example, if the table top 12 does not fold-in-half, the lip 30 may be a continuous structure with no breaks or openings. On the other hand, if the table top 12 does fold-in-half, then the lip may be a continuous structure on each half of the table top. The lip 30 could also be contiguous and may include one or more portions that abut or are disposed proximate to each other. In addition, the lip 30 could include one or more sections that are spaced apart by a distance.

The inner and outer portions 32, 34 of the lip 30 may be separated by a distance, which may be referred to as a thickness or width of the lip. The thickness of the lip 30 may be generally constant along one or more of the sides 18, 20 and/or ends 22, 24 of the table top 12. In particular, the thickness of the lip 30 may be the same along the sides 18, 20 and ends 22, 24 of the table top 12. The lip 30, however, may have a different thickness in one or more of the corners 28. For example, the lip 30 in the corners 28 may have a much smaller thickness than along the sides 18, 20 and/or ends 22, 24. Specifically, the inner portion 32 of the lip 30 in the corners 28 may be disposed towards the outer portion 34 of the lip to decrease the thickness. For instance, the inner portion 32 of the lip 30 may be curved towards the outer portion 34 of the lip. In greater detail, as shown in the accompanying figures, the inner portion 32 of the lip 30 may have a curvilinear configuration with at least one outwardly curved portion 38 in each of the corners 28.

For example, the lip 30 may have a thickness in the range between about three-quarters (0.75) inch and about one and one-half (1.5) inches along the sides 18, 20 and ends 22, 24 of the table top 12. In particular, the lip 30 may have a thickness of about one and one-quarter (1.25) inches along the sides 18, 20 and ends 22, 24 of the table top 12. While the lip 30 may have generally the same size along the sides 18, 20 and ends 22, 24 of the table top 12, each or both of the sides and/or the ends could be larger or smaller. For example, the ends 22, 24 could be slightly larger than the sides 18, 20 because that portion of the lip 30 could help strengthen that portion of the table top 12. As discussed above, the lip 30 in the corners 28 may have a much smaller thickness. For instance, the lip 30 in the corners 28 may have a thickness in the ranged between about one-eighth (0.125) inch and about three-quarters (0.75) inch. Preferably the lip 30 in the corners 28 has a thickness of about one-half (0.5) inch. Thus, the thickness of the lip 30 in the corners 28 may be less than half the thickness of the lip in the sides 18, 20 and/or ends 22, 24 of the table top 12.

The inner portion 32 of the lip 30 may further include one or more alignment members 40, which may extend inwardly from the inner portion of lip and may be disposed along the sides 18, 20 of the table top 12. The alignment members 40 may be located at least proximate the outwardly curved portions 38. In particular, an alignment member 40 may be disposed adjacent to the outwardly curved portion 38 in each of the corners 28. Advantageously, the table top 12, the lip 30, the outwardly curved portions 38 and/or the alignment members 40 may be integrally formed as part of a unitary, one-piece structure if the table top is constructed from blow-molded plastic. In addition, the table top 12, the lip 30, the outwardly curved portions 38 and/or the alignment members 40 may include hollow interior portions that are formed during the blow-molding process and these hollow interior portions may be in direct communication.

The table 10 may also include a frame 42 and a portion of the frame may be disposed at least proximate the lip 30. Advantageously, the alignment members 40 may help position the frame 42. For example, the ends of the frame 42 may be disposed proximate or contact an engagement surface 44 of the alignment members 40. In greater detail, the frame 42 may include a first side rail 46 disposed at least proximate a first portion of the lip 30 disposed along the first side 18 of the table top 12 and a second side rail 48 disposed at least proximate a second portion of the lip disposed along the second side 20 of the table top. The first and second side rails 46, 48 may be disposed between the alignment members 40. In addition, an end of the side rails 46, 48 may be sized and configured to abut or contact the engagement surfaces 44 of the alignment members 40, which may help maintain the side rails in a fixed position. Further, the side rails 46, 48 may be at least partially or substantially enclosed by the lower portion 16 of the table top 12, the lip 30 and/or the alignment members 40. This may beneficially help maintain the frame 42 and/or the side rails 46, 48 in a fixed position, which may help create a more sturdy and robust table 10. The table 10 may also support a larger amount of weight or force because the side rails 46, 48 may be at least partially enclosed and the frame 42 may be securely connected to the table top 12 in a fixed position.

The table 10 may also include a one or more support structures 50, which may be sized and configured to support the table top 12 above a surface such as the floor or ground. The support structures 50 may include one or more legs or supports 52 and the support structures may be movable between an extended or use position and a collapsed or storage position relative to the table top 12. As shown in the accompanying figures, the support structures 50 may include a pair of legs or supports 52 and a connecting member 54 may interconnect the supports.

If desired, the support structures 50 may be connected to the frame 42. In addition, the support structures 50 may be movably connected to the frame 42 to allow the legs 52 to move between an outwardly extending or use position and a collapsed or storage position. For example, the support structures 50 may include or be connected to cross members 56, 58 and the legs 52 may be connected to the cross members. The cross members 56, 58 may then be connected to the frame 42. In particular, the cross members 56, 58 may be connected to the side rails 46, 48 of the frame 42. It will be appreciated that the cross members 56, 58 may also be part of the frame 42.

The support structures 50 and/or the legs 52, however, do not have to be connected to the cross members 56, 58 or the frame 42. Instead, the support structures 50 and/or the legs 52 may be connected to any suitable portions of the table 10. It will also be appreciated that the table 10 may include any suitable number of support structures 50 and/or legs 52 depending, for example, upon the intended use of the table. In addition, it will be appreciated that the table top 12, the support structures 50 and the legs 52 may have various sizes, shapes, configurations and arrangements depending, for example, upon the intended use of the table 10. It will further be appreciated that the frame 42, the side rails 46, 48 and/or the cross members 56, 58 are not required; and the table 10 may have other components, features, aspects, characteristics and the like, if desired.

The table 10 may also include first and second brace assemblies 60, 62, which may be connected to the support structures 50. In particular, the first and second brace assemblies 60, 62 may be connected to the legs 52 and may be sized and configured to allow the legs to move between the use and storage positions. The brace assemblies 60, 62 may include a first portion 64 connected to the legs 52 and a second portion 66 connected to a cross member 68 and/or the table top 12. The brace assemblies 60, 62 may be locked in position by a locking mechanism such as a locking ring.

The table 10 is preferably sized and configured to be stacked with one or more additional tables. The tables 10 are preferably nested together to reduce the height of the stacked tables, which may allow the tables to be shipped, stored and transported in a smaller area. This may result in significant cost savings to the manufacturer, for example, because less storage space may be required and a substantial reduction in transportation costs may be achieved.

The table 10, for example, may include a first surface, such as a contact surface 70, that is sized and configured to contact an adjacent, nested table. The contact surface 70 may be part of the lip 30 and the contact surface may be sized and configured to contact an upper portion of the adjacent, nested table. In particular, the contact surface 70 may be a first portion, such as an interior portion, of the lower portion 36 of the lip and the contact surface may have a generally planar, flat or level configuration. Additionally, the contact surface 70 may be disposed in a single plane and the contact surface may be disposed generally parallel to the upper portion 14 of the table top 12. Advantageously, the contact surface 70 may be sized and configured to abut or contact a portion of the upper surface of the adjacent, nested table. Thus, the contact surface 70 may be a smooth surface that is at least substantially free from projections to match the generally flat, even upper surface of the adjacent, nested table. It will be appreciated that the contact surface 70 may also have configurations and arrangements depending, for example, upon the shape, contour or form of the adjacent, nested table.

In greater detail, the contact surface 70 may be a continuous surface that is unbroken or uninterrupted. For instance, if the table top 12 does not fold-in-half, the contact surface 70 may not include any openings or breaks. However, if the table top 12 does fold-in-half, then the contact surface 70 may include portions that are contiguous, abutting or spaced apart. While the contact surface 70 may be disposed at least proximate the perimeter 26 of the table top 12 and may extend about the entire lower surface 16 of the table top, the contact surface could also be spaced inwardly and may include any suitable number of openings or gaps.

Significantly, if the contact surface 70 is disposed about at least a majority of the table top 12, the contact surface may have a large surface area and that may allow the nested tables to support a significant amount of weight or force without being damaged because the load may be spread out over a larger area. Further, the contact surface 70 may be disposed towards an inner portion of the lower portion 36 of the lip 30 so that it can contact the upper surface of the adjacent, stacked table. It will be understood that the contact surface 70 may also be formed by other suitable portions of the lip 30 and/or table top 12.

The table top 12 may also include an engaging portion 72 that is sized and configured to be disposed in a receiving portion of an adjacent, stacked table. In particular, the engaging portion 72 may be sized and configured to nest or be inserted into a receiving portion of the adjacent, stacked table to allow a portion of the table top 12 to overlap, mesh or engage the table top of the adjacent, stacked table.

For example, as shown in the accompanying figures, the engaging portion 72 may extend outwardly from the lip 30. In particular, the engaging portion 72 may extend downwardly from a second or outer portion of the lower portion 36 of the lip 30. In addition, the engaging portion 72 may be disposed adjacent to the contact surface 70. For example, if the contact surface 70 is formed by a first, inner portion of the lower portion 36 of the lip 30, then the engaging portion 72 may be formed by a second, outer portion of the lower portion of the lip. Advantageously, if the contact surface 70 and engaging portion 72 are disposed next to each other, multiple adjacent surfaces may contact or abut when the tables 10 are nested together.

In greater detail, the engaging portion 72 may be disposed about the perimeter 26 of the table top 12. The engaging portion 72 may also be generally aligned with the outer edge or sidewall of the table top 12. While the engaging portion 72 may be disposed about the periphery of the lip 30 and/or the table top 12, the engaging portion may also be spaced inwardly. Advantageously, the engaging portion 72 may be a continuous structure that is disposed along the first and second sides 18, 20, the first and second ends 22, 24 and the corners 28 of the table top 12. If the engaging portion 72 is uninterrupted, then it may provide a large contact area with an adjacent, stacked table. The engaging portion 72, however, could also be a contiguous structure with one or more portions that abut or disposed proximate to each other. It will be appreciated that the engaging portion 72 could further include one or more portions that are spaced apart depending, for example, upon the configuration of the table top 12.

The engaging portion 72 may have a generally constant size, such as height and width, and it may have a generally U-shaped configuration. For example, the engaging portion 72 may include an inner portion 74 disposed towards the contact surface 70 and an inner portion of the table top 12, an outer portion 76 disposed towards the outer portion 34 of the lip 30, and a lower portion 78. The engaging portion 72 may also include one or more surfaces and these surfaces may be sized and configured to contact or abut the table top of an adjacent, stacked table.

The engaging portion 72 may be formed from compression molded plastic. For example, if the table top 12 is formed from blow-molded plastic, then the engaging portion 72 may be compression molded during the blow-molding process.

The compression molded engaging portion 72 may be formed by having the inner portion 74 and the outer portion 76 directly touch or contact each other so there is no gap between the inner and outer portions. Because the compression molded engaging portion 72 may have a double-wall thickness, it may create a stronger, more rigid and/or more impact resistant structure. The compression molding may allow the engaging portion 72 to be relatively thin because there is little or no space between the inner and outer walls 74, 76 of the compression molded plastic structure.

The engaging portion 72 may also be formed from other suitable processes. For example, the engaging portion 72 may include a hollow interior portion that is in direct communication with a hollow interior portion of the lip 30 and/or the table top 12. If the table top 12 and the engaging portion 72 are constructed from blow-molded plastic, then the table top, the lip 30 and the engaging portion may be integrally formed as part of a unitary, one-piece construction.

As mentioned above, the engaging portion 72 may have a generally uniform size and configuration. In addition, the engaging portion 72 may be directly adjacent to the contact surface 70. For example, the engaging portion 72 may have a width between about one-eighth (0.125) inch and about one-half (0.5) inch. In particular, the engaging portion 72 may have a width of about two-tenths (0.2) inch or about one-quarter (0.25) inch. The engaging portion 72 may have a height between about one-tenth (0.1) inch and about one-half (0.5) inch. Preferably, the engaging portion 72 has a height of about one-eighth (0.125) inch. Advantageously, the engaging portion 72 may be integrally formed with the table top 12 as part of a unitary, one-piece construction. In addition, the relatively small size of the engaging portion 72 may allow it to be created during the manufacturing process. For instance, the engaging portion 72 may be a protrusion that is formed during a molding process, such as blow-molding.

While the engaging portion 72 may have a consist size, the contact surface 70 may change in size. For example, the contact surface 70 may have a size in the range between about one-half (0.5) inch and about one and one-half (1.5) inches along the sides 18, 20 and the ends 22, 24 of the table top 12. In particular, the contact surface 70 may have a size of about one (1.0) inch along the sides 18, 20 and the ends 22, 24 of the table top. The contact surface 70, however, may be much smaller in the corners 28. For instance, the contact surface 70 may have a size in the range between about one-eighth (0.125) inch and about one-half (0.5) inch, such as about one-quarter (0.25) inch. The contact surface 70 may also be smaller and may be almost or completely nonexistent in the corners 28. One or more portions of the contact surface 70 may also be larger, such as at or proximate the alignment members 40, depending, for example, upon the intended use of the table 10. Advantageously, the constant size of the engaging portion 72 may facilitate stacking and alignment of the tables 10. In addition, the constant size of the engaging portion 72 may allow the tables 10 to be stacked in different arrangements and orientations. The smaller size of the contact surfaces 70 in the corners 28 may facilitate manufacturing of the table top 12, especially if the table top is constructed from blow-molded plastic. The smaller size of the contact surfaces 70 in the corners 28 may also help prevent the corners 28 from being damaged by, for example, limiting the amount of weight or force applied to the corners. The larger, generally constant size of the contact surfaces 70 along the sides 18, 20 and ends 22, 24 may help distribute weight or force more evenly on the nested table. One of ordinary skill in the art will appreciate, after reviewing the disclosure herein, the contact surfaces 70 and engaging portions 72 may have other shapes, sizes, configurations and arrangements depending, for example, upon the type or intended use of the table 10.

The table top 12 may include a receiving or nesting portion 80 that is sized and configured to facilitate nesting of the tables. The nesting portion 80 is preferably disposed about the perimeter 26 of the table top 12. In particular, the nesting portion 80 is preferably disposed about the entire perimeter 26 of the table top 12 including the sides 18, 20, the ends 22, 24 and the corners 38. The nesting portion 80 may be at least partially disposed in the upper surface 14 and the sidewall of the table top 12. Desirably, the nesting portion 80 may be disposed below a plane aligned with the upper surface 14 of the table top 12. The nesting portion 80 is preferably sized and configured to receive the engaging portion 72 of an adjacent, nested table. The nesting portion 80 may be integrally formed with the table top 12 as part of a unitary, one-piece construction during the molding process if, for example, the table top is constructed from molded plastic.

In greater detail, the nesting portion 80 may be disposed at least proximate the intersection of the upper surface 14 and the perimeter or side wall 26. Additionally, the nesting portion 80 may have a generally L-shaped configuration that is open on two sides, which may help facilitate alignment and nesting of the tables 10. As shown in the accompanying figures, the nesting portion 80 may be a groove or channel with a height H and a width W. The height H is preferably between about one-tenth (0.1) inch and about one-half (0.5) inch, such as about one-eighth (0.125) inch, and the width W may be larger than the height by a factor such as two, three or more. For example, the width W may be approximately two times the height H such that, in this exemplary embodiment, if the height is about one-eighth (0.125) inch, then the width may be about one-quarter (0.25) inch. The height H and the width W may also be approximately the same. For instance, if the height H is about one-eighth (0.125) or about one-quarter (0.25) inches, then the width W may also be about one-eighth (0.125) or about one-quarter (0.25) inch. It will also be appreciated that the width W may be smaller than the height H. Thus, for example, if the height H is about four-tenths (0.4) inch, then the width W may be about three-tenths (0.3) inches or less. It will be understood that the height H and/or the width W may vary depending, for example, upon the intended use of the table 10.

The exemplary dimensions for the contact surface 70, the engaging portion 72 and the nesting portion 80 given about may be used in connection with a table top 12 that has a lip 30 with a height of about one and one-half (1.5) inches measured from the upper surface 14 to the lower portion 36. It will be understood that the contact surface 70, the engaging portion 72 and/or the nesting portion 80 could also larger or smaller depending, for example, upon the size, shape, configuration or arrangement of the table top 12. It will also be understood that the table top 12, along with one or more of its various components and features, may have other suitable sizes, shapes, configurations and arrangements depending, for example, upon the intended use of the table 10.

As discussed above, the nesting portion 80 may be sized and configured to receive the engaging portion 72. In particular, the inner portion 74 of the engaging portion 72 may contact a sidewall 82 of the receiving portion 80 and/or the lower portion 78 of the engaging portion may contact a lower wall 84 of the receiving portion. For example, the inner portion 74 of the engaging portion 72 may have a height substantially equal to the height of the nesting portion 80 and the lower portion 78 of the engaging portion may have a width substantially equal to the width of the nesting portion. Advantageously, because the receiving portion 80 may be a strong and sturdy portion of the table top 12, the lower wall 84 may be able to support a relatively large amount of force or weight. In addition, the contact of the inner portion 74 of the engaging portion 72 with the sidewall 82 of the receiving portion may help align the tables 10 and may tend to keep the tables in the nested configuration. While the receiving portion 80 may be sized and configured to receive the engaging portion 72 of an adjacent, stacked table and the receiving portion may be disposed about the entire perimeter 26 of the table top 12, the receiving portion can also have other appropriate shapes, sizes, configurations and arrangements depending, for example, upon the engaging portion and/or the intended use of the table 10.

Advantageously, the nested tables may have multiple contact surfaces or areas. In addition, the contact areas or surface may be continuous or uninterrupted, which may allow forces to be more evenly distributed. For example, the lower portion 78 of the engaging portion 72 may contact or abut the lower wall 84 of the receiving portion 80 of the adjacent, stacked table. The inner portion 74 of the engaging portion 72 may also contact or abut the sidewall 82 of the receiving portion 80 of the adjacent, stacked table. Additionally, the contact surface 70 may contact or abut the upper surface 14 of the adjacent, stacked table. The multiple contact areas may create multiple load bearing surfaces that allow a load or force to be shared or distributed over a larger area, which may permit the table 10 to support more weight and may help prevent damage to the table top 12.

In addition, the frame 42 may include one or more surfaces that are sized and configured to contact or abut an adjacent, nested table. For example, a lower surface 86 of the side rails 46, 48 of the frame 42 may be sized and configured to contact or abut the upper surface 14 of the adjacent, nested table. Thus, the frame 42 may also help protect the table top 12 of the adjacent, nested table from damage because it may provide another area of contact between adjacent, nested tables 10. Therefore, the frame 42 may further help distribute loads or forces over a larger area, which may increase the amount of weight that may be supported by a table 10.

Advantageously, the engaging portion 72 and the receiving portion 80 may facilitate nesting of the tables 10, which may significantly reduce the height of a plurality of stacked tables. The reduction in height of the stacked tables 10 may be particularly advantageous when manufacturing, shipping, storing and displaying of the tables. Further, while the table top 12 may have the same general size, configuration and appearance as a conventional table top, the table top 12 may allow two or more stacked tables to be nested together.

For instance, the table top 12 may have a height measured from the upper surface 14 to the lower portion 78 of the engaging portion 72 that is about one and five-eighths (1.625) inches. Because the engaging portion 72 may be disposed in a receiving portion 80 of an adjacent, nested table 10, the table may only have a height of about one and one-half (1.5) inches in the stacked configuration. This may result in a decrease in height of a table 10 in the stacked configuration of more than seven percent (7%). This may allow seven percent more tables to be loaded into a conventional shipping container. This may also allow the same number of tables 10 to be disposed in an area that is seven percent smaller than a conventional table with the same size and shape.

One of ordinary skill in the art may appreciate after reviewing this disclosure that the tables disclosed herein may have a number of different aspects, features, characteristics and configurations. The tables may also have other suitable aspects, features, characteristics and configurations such as disclosed in Assignee's U.S. Pat. No. 7,069,865, entitled HIGH-STRENGTH, LIGHTWEIGHT BLOW-MOLDED PLASTIC STRUCTURES, issued Jul. 4, 2006; U.S. patent application Ser. No. 11/372,515, entitled HIGH-STRENGTH, LIGHTWEIGHT BLOW-MOLDED PLASTIC STRUCTURES, filed Mar. 9, 2006; U.S. patent application Ser. No. 13/455,041, entitled TABLES WITH NESTING TABLE TOP, filed Apr. 24, 2012; U.S. patent application Ser. No. 13/455,055, entitled FRAME FOR A TABLE, filed Apr. 24, 2012; U.S. patent application Ser. No. 13/455,073, entitled TABLE WITH MOLDED PLASTIC TABLE TOP, filed Apr. 24, 2012; U.S. patent application Ser. No. 13/455,076 entitled TABLE WITH MOLDED PLASTIC TABLE TOP, filed Apr. 24, 2012; U.S. patent application Ser. No. 13/455,081, entitled TABLE TOP, filed Apr. 24, 2012; and U.S. patent application Ser. No. 13/455,066, entitled TABLE, filed Apr. 24, 2012. Each of these patents and applications are incorporated by reference in its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table top sized and configured to nest with a table top of an adjacent table to reduce a height of a plurality of stacked tables in a nested configuration, each table top of a plurality of stacked tables being substantially identical, the table top comprising:

an upper surface;

a sidewall extending downwardly relative to the upper surface;

a nesting portion at least partially formed in the upper surface and the sidewall;

a lower surface spaced apart from the upper surface; and a lip downwardly extending from the lower surface, the lip comprising:

a contact surface in a first lower portion of the lip, the contact surface sized and configured to contact an upper surface of a table top of an adjacent table when the table is nested with the adjacent table; and an engaging portion in a second lower portion of the lip, the engaging portion sized and configured to be disposed in a nesting portion of a table top of the adjacent table when the table is nested with the adjacent table, wherein the table top is constructed from blow-molded plastic and the upper surface, the sidewall, the nesting portion, the lower surface, the lip, the contact surface and the engaging portion are integrally formed as part of a unitary, one-piece construction during a blow-molding process.

2. The table top as in claim 1, wherein the nesting portion is disposed about an upper perimeter of the table top;

wherein the engaging portion is disposed about a lower perimeter of the table top; and wherein the contact surface is disposed directly adjacent to the engaging portion in the second lower portion of the lip.

3. The table top as in claim 1, wherein the table top has a wall thickness measured between an inner surface and an outer surface; and wherein the engaging portion has a thickness approximately equal to twice the wall thickness.

4. A table sized and configured to nest with an adjacent table to reduce a height of a plurality of stacked tables in a nested configuration, each table of a plurality of stacked tables being substantially identical, the table comprising:

a table top constructed from molded plastic, the table top comprising:

an upper surface;

a sidewall extending downwardly relative to the upper surface;

a lower surface spaced apart from the upper surface;

a nesting portion disposed at least proximate a perimeter of the table top; and a lip extending downwardly, the lip comprising;

a contact surface in a first lower portion of the lip sized and configured to contact an upper surface of a table to of an adjacent table when the table is nested with the adjacent table;

an engaging portion in a second lower portion of the lip sized and configured to be disposed in a nesting portion of a table top of the adjacent table when the table is nested with the adjacent table;

a frame comprising:

a first side rail disposed at least proximate a first side of the table top, a lower portion of the first side rail sized and configured to contact an upper surface of the adjacent table when the table is nested with the adjacent table; and a second side rail disposed at least proximate a second side of the table top, a lower portion of the second side rail sized and configured to contact an upper surface of the adjacent table when the table is nested with the adjacent table; and one or more support structures connected to the table top, the support structures movable between an extended position and a collapsed position relative to the table top.

5. The table as in claim 4, wherein the table top is constructed from blow-molded plastic and the upper surface, the sidewall, the lower surface, the nesting portion, the lip, the contact surface and the engaging portion are integrally formed as part of a unitary, one-piece construction during a blow-molding process.

6. The table as in claim 4, wherein the contact surface is directly adjacent to the engaging portion in the second lower portion of the lip.

7. The table as in claim 4, wherein the engaging portion is disposed about an outer periphery of the second lower portion of the lip; and wherein the contact surface is disposed about an inner periphery of the first lower portion of the lip.

8. The table as in claim 4, wherein the contact surface has a generally constant width along a side of the table top; and wherein the contact surface has a width in a corner less than one-half the width along the side of the table top.

9. The table as in claim 4, wherein the contact surface has a generally constant width along a first side of the table top, a second side of the table top, a first end of the table top and a second end of the table top; and wherein the contact surface has a width in a corner that is less than one-half the width along the first side, the second side, the first end or the second end.

10. A table top sized and configured to nest with an adjacent table top when the table tops are disposed in a stacked configuration, the table top comprising:

an upper portion;

a sidewall extending downwardly relative to the upper portion;

a receiving portion disposed at least proximate an intersection of the upper portion and the sidewall;

a lower portion spaced apart from the upper portion;

a lip extending downwardly from the lower portion, the lip comprising:

a contact surface formed by a first lower portion of the lip, the contact surface sized and configured to contact an upper portion of a table top of an adjacent, stacked table; and an engaging portion formed by a second lower portion of the lip, the engaging portion sized and configured to be disposed in a receiving portion of a table top of an adjacent, stacked table, wherein the contact surface has a width generally equal to or smaller than a width of the engaging portion in a corner of the table top; and wherein the contact surface has a width at least twice as large as a width of the engaging portion along a first side and along a second side of the table top.

11. The table top as in claim 10, wherein the contact surface is directly adjacent to the engaging portion.

12. The table top as in claim 10, wherein the engaging portion is disposed about an outer periphery of the second lower portion of the lip; and wherein the contact surface is disposed about an inner periphery of the first lower portion of the lip.

13. The table top as in claim 10, wherein the contact surface has a generally constant width along a side of the table top; and wherein the contact surface has a width in a corner less than one-half the width along the side of the table top.

14. The table top as in claim 10, wherein the contact surface has a generally constant width along a first side of the table top, a second side of the table top, a first end of the table top and a second end of the table top; and wherein the contact surface has a width in a corner of the table top that is less than one-half of the width along the first side, the second side, the first end or the second end of the table top.

15. The table top as in claim 10, wherein a lower portion of the engaging portion contacts a lower wall of a receiving portion of a table top when the table top is nested with an adjacent, stacked table; and wherein the contact surface contacts an upper portion of a table top when the table top is nested with an adjacent, stacked table.

16. The table top as in claim 10, further comprising:

a frame attached to the table top, the frame including a first side rail disposed at least proximate a first portion of the lip disposed along a first side of the table top and a second side rail disposed at least proximate a second portion of the lip disposed along a second side of the table top;

a first pair of alignment members extending inwardly from an inner portion of the first portion of the lip, the first side rail disposed between the first pair of alignment members, the first pair of alignment members including a lower surface generally aligned and coplanar with the contact surface; and a second pair of alignment members extending inwardly from an inner portion of the second portion of the lip, the second side rail disposed between the second pair of alignment members, the second pair of alignment members including a lower surface generally aligned and coplanar with the contact surface.

17. The table top as in claim 10, further comprising a frame attached to the table top, the frame comprising:

a first side rail disposed at least proximate a first portion of the lip disposed along a first side of the table top, the first side rail including a lower portion generally aligned and coplanar with the contact surface; and a second side rail disposed at least proximate a second portion of the lip disposed along a second side of the table top, the second side rail including a lower portion generally aligned and coplanar with the contact surface.

18. The table top as in claim 10, wherein the table top is constructed from blow molded plastic and the lip, the engaging portion and the contact portion are integrally formed as part of a unitary, one-piece structure during a blow-molding process; and wherein the table top, the lip and the engaging portion each include a hollow interior portion that is formed during the blow-molding process, the hollow interior portions of the table top, the lip and the engaging portion being in direct communication during the blow-molding process.

* * * * *

UNITED STATES PATENT AND TRADEMARK OFFICE

CERTIFICATE OF CORRECTION

PATENT NO. : 8,683,929 B2
APPLICATION NO. : 13/592230
DATED : April 1, 2014
INVENTOR(S) : Peery et al.

It is certified that error appears in the above-identified patent and that said Letters Patent is hereby corrected as shown below:

In the Specification

In Column 12, Line 9, delete "corners 38." and insert -- corners 28. --, therefor.

In the Claims

In Column 14, Lines 25-26, in Claim 1, after "nest with", delete "a table top of".

In Column 15, Line 9, in Claim 4, delete "comprising;" and insert -- comprising: --, therefor.

In Column 15, Line 12, in Claim 4, delete "to of an" and insert -- top of an --, therefor.

Signed and Sealed this
Twenty-second Day of July, 2014

Michelle K. Lee

Michelle K. Lee
*Deputy Director of the United States Patent and Trademark Office*